US007082641B1

(12) United States Patent
Jung et al.

(10) Patent No.: US 7,082,641 B1
(45) Date of Patent: Aug. 1, 2006

(54) SYSTEMS AND METHODS FOR REPLACEABLE LUGGAGE HANDLE

(75) Inventors: In-Soo Jung, Yongin-Si (KR); Byung Ki Choi, Soeul (KR)

(73) Assignee: Dong-In Entech Co., Ltd., Gimpo-Si (KR)

( * ) Notice: Subject to any disclaimer, the term of this patent is extended or adjusted under 35 U.S.C. 154(b) by 26 days.

(21) Appl. No.: 10/712,614

(22) Filed: Nov. 12, 2003

(51) Int. Cl.
*B25G 1/04* (2006.01)

(52) U.S. Cl. ..... 16/114.1; 16/113.1

(58) Field of Classification Search ..... 16/114.1, 16/113.1, 405, 429; 190/18 R, 18 A, 115; 24/457, 458; 248/218.4, 205.1; 403/300, 403/309, 361, 377, 373, 345; 280/47.315, 280/47.371, 37, 655
See application file for complete search history.

(56) References Cited

U.S. PATENT DOCUMENTS 2,194,800 A * 3/1940 Ley ..... 403/366
2,537,750 A * 1/1951 Gretschel ..... 190/116
4,352,586 A * 10/1982 Hayden ..... 403/163
4,683,610 A * 8/1987 Richards et al. ..... 16/429
5,131,116 A * 7/1992 Bowdler ..... 16/427
5,167,306 A * 12/1992 Carrigan, Jr. ..... 190/18 A
5,199,811 A * 4/1993 Huang ..... 403/108
5,335,759 A * 8/1994 Yeh ..... 190/115
5,590,891 A * 1/1997 Kazmark, Jr. ..... 280/37
5,613,273 A * 3/1997 Tsai ..... 16/113.1
5,653,319 A * 8/1997 Wang ..... 190/115
5,730,264 A * 3/1998 Lu ..... 190/108
5,809,616 A * 9/1998 Porter, Sr. ..... 16/429
5,810,399 A * 9/1998 Platano ..... 285/38
6,270,302 B1 * 8/2001 Lyons ..... 411/8
6,292,979 B1 * 9/2001 Kuo ..... 16/113.1
6,295,739 B1 * 10/2001 Kraft ..... 33/758

FOREIGN PATENT DOCUMENTS

DE 2742557 A * 3/1979

* cited by examiner

*Primary Examiner*—Chuck Y. Mah
(74) *Attorney, Agent, or Firm*—Paul, Hastings, Janofsky & Walker, LLP

(57) ABSTRACT

A transport device comprises a replaceable telescoping handle. Replacement is achieved by including a release and retaining mechanism in a base to which the telescoping handle is installed. A user can obtain a replacement telescoping handle, release and remove a broken telescoping handle using the release and retaining mechanism, and then install the replacement telescoping handle.

20 Claims, 4 Drawing Sheets

SYSTEMS AND METHODS FOR REPLACEABLE LUGGAGE HANDLE

BACKGROUND

1. Field of the Invention

The field of the invention relates generally to a telescoping handle for transport devices and more particularly to facilitating easy removal and replacement of the telescoping handle when necessitated by damage.

2. Background Information

A typical telescoping handle design for transport devices, such as wheeled luggage, often comprises two telescoping poles, one on either side of the transport device. Each telescoping poles often comprises two segments, an inner telescoping segment and an outer segment affixed to the transport device itself. The telescoping poles allow the user to extend the handle to a comfortable length while pulling the transport device. But the telescoping poles can also be collapsed to allow the handle to be retracted whenever it is convenient, e.g., when the transport device is stowed.

Locking pins are often used to secure the extended position of the handle to prevent the handle from collapsing unexpectedly. Sometimes, the locking pins are spring-loaded bearings that require substantial axial force to collapse the telescoping pole. In other cases, the locking pins are mechanically coupled to an actuator on the handle, which does not disengage the lock unless the button is depressed. In other instances, a combination of an actuator and spring-loaded bearings can be used. In any event, the locking pins must be received by a hole in the opposite segment of the telescoping pole. Typically, the segments are hollow tubes with their outer width or diameters decreasing in size so as to allow each successive segment to fit inside one another.

The convenience of these telescoping handles notwithstanding, there currently exists a persistent problem of handle breakage owing to the high torsional and bending loads that are sometimes placed on the telescoping poles during use. Another frequent cause of failure can also be the actuator in the handle. It has been reported the 90% of warranty claims for wheeled luggage of this type is for replacement of broken telescoping handles.

Owing to the difficulty and skill required, telescoping handle replacement is almost always performed by a specialized technician, which adds to the expense and inconvenience of repair for both the user and the supplier of the transport device. Alternatively, users just stop using the transport device, which adds to their expense and can detract from their satisfaction.

SUMMARY OF THE INVENTION

A transport device comprises a replaceable telescoping handle. Replacement is achieved by including a release and retaining mechanism in a base to which the telescoping handle is installed.

In one aspect, a user can obtain a replacement telescoping handle, release and remove a broken telescoping handle using the release and retaining mechanism, and then install the replacement telescoping handle.

These and other features, aspects, and embodiments of the invention are described below in the section entitled "Detailed Description of the Preferred Embodiments."

BRIEF DESCRIPTION OF THE DRAWINGS

Features, aspects, and embodiments of the inventions are described in conjunction with the attached drawings, in which.

DETAILED DESCRIPTION OF THE PREFERRED EMBODIMENTS

While the embodiments illustrated in the figures and described below are generally applicable to wheeled luggage implementations, it will be understood that the systems and methods described herein can be applied more generally to any type of transport device. For example, a hand truck can take advantage of the systems and methods described. Thus, the systems and methods described herein should not be seen as being limited to any particular type of transport device.

Figure 1:
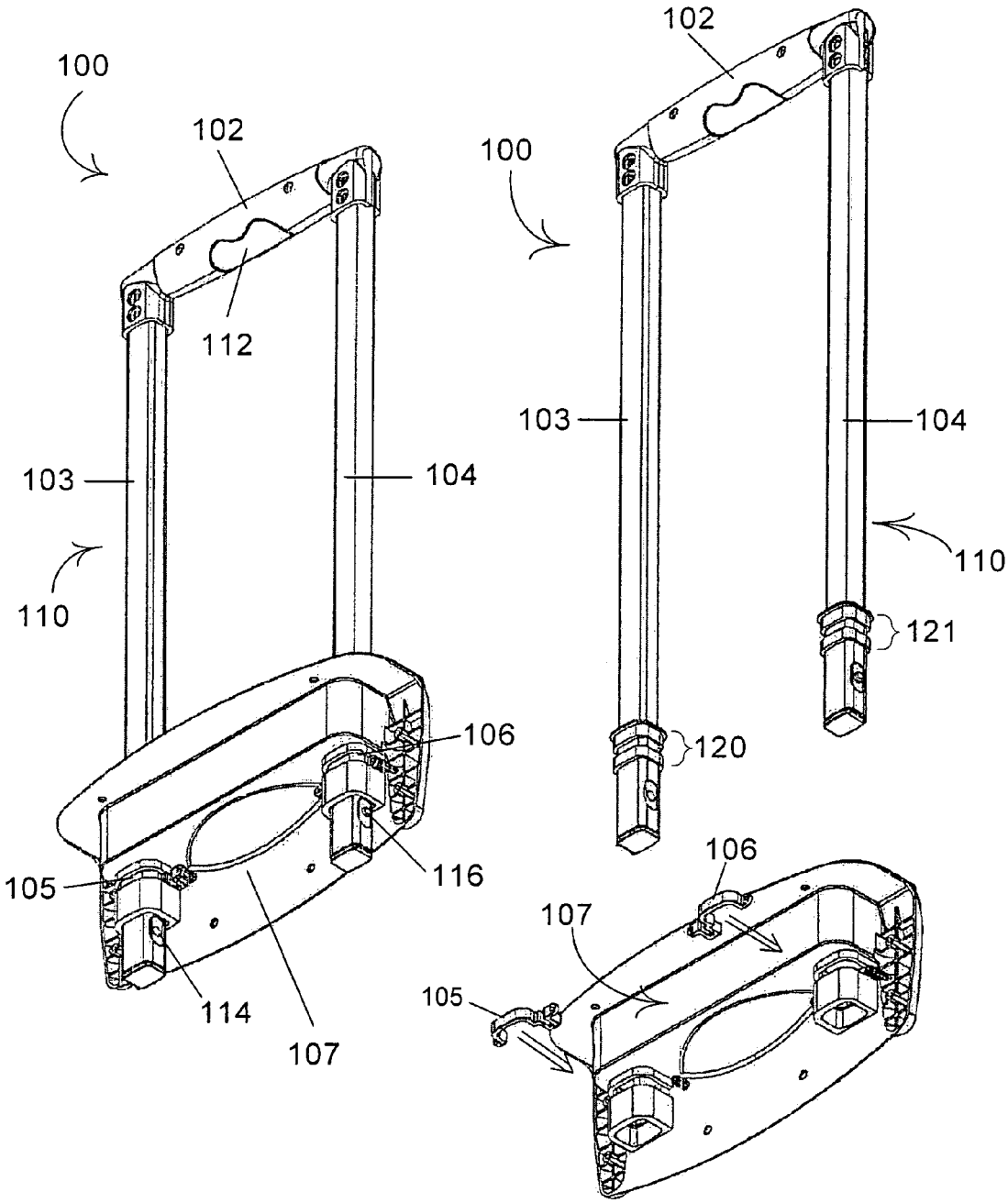
FIG. 1 is a diagram illustrating a replacement telescoping handle assembly in accordance with one example embodiment.

FIG. 1 is a diagram illustrating a replacement telescoping handle assembly 100 configured in accordance with one example embodiment of the systems and methods described herein. On the left hand side of FIG. 1, replaceable telescoping handle 110 is shown mounted to a mounting base 107, which can for example, in turn be mounted to a transport device, such a piece of wheeled luggage. Replaceable telescoping handle 110 comprise two telescoping poles 103 and 104, which can be configured as described above. In the embodiment illustrated in FIG. 1, replaceable telescoping handle 110 also comprise an actuator 112 in handle 102 configured to enable replaceable telescoping handle 110 to be extended upon actuation.

Thus, when actuator 112 is actuated, locking pins 114 and 116 at the bottom of telescoping poles 103 and 104 are retracted, which allows an inner segment (not shown) of telescoping poles 103 and 104 to slide within the outer segments of telescoping poles 103 and 104, allowing telescoping handle 110 to be fully extended. Telescoping poles 103 and 104 can be prevented from disengaging mounting block 107, however, by release and retaining mechanisms 105 and 106. As long as release and retaining mechanisms 105 and 106 are installed, then telescoping handle 110 will not disengage from mounting block 107 when it is being extended.

The failure point in transport device that incorporate telescoping handles, such as telescoping handle 110, is often the telescoping handle itself. For example, failure can occur in telescoping handles 103 and 104, where the bending or torsional forces can occasionally momentarily exceed the failure limit of telescoping handles 103 and 104 leading to localized buckling and collapse, or other problems. Additionally, actuator 102 can fail due to excessive use, or stress. When catastrophic breakage of telescoping handle 110 occurs, the usefulness of the associated transport device is substantially lost. Unfortunately, conventional replacement is costly, inconvenient, or both, because conventional telescoping handle assemblies are not designed for easy replacement.

As can be seen on the right hand side of FIG. 1, however, when release and retaining mechanisms 105 and 106 are removed, then telescoping handle 110 is free to be disengaged from mounting base 107. Accordingly, if telescoping handle 110 is damaged, release and retaining mechanisms 105 and 106 can be removed and telescoping handle 110 can then be removed and replaced with a new handle. Release and retaining mechanisms 105 and 106 can then be reinstalled and the life of the associated transport device can be extended without the cost or inconvenience of taking the transport device to a service center for repair.

Figure 2:
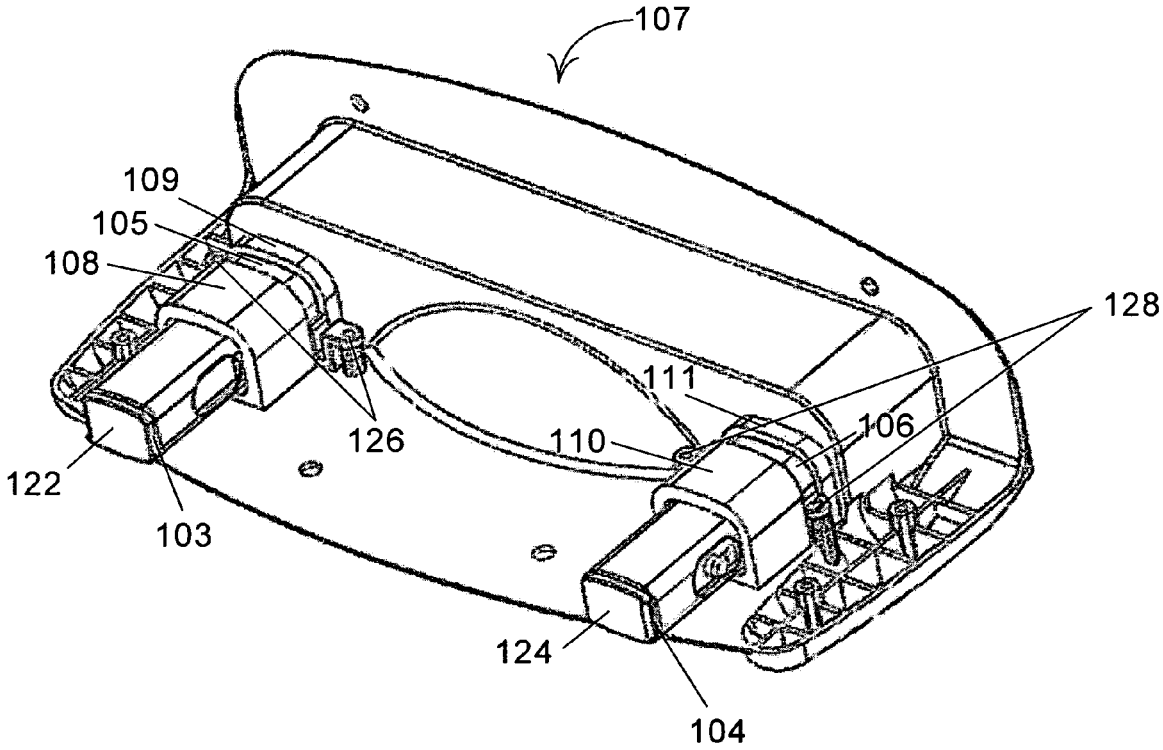
FIG. 2 is a diagram illustrating an exemplary embodiment of a mounting base that is included in the assembly of FIG. 1.

In the embodiment of FIG. 1, release and retaining mechanisms 105 and 106 each comprise a retaining clip that is installed and removed using a screw on either side of the retaining clip as described in more detail in relation to FIG. 2. It should be understood, however, that release and retaining mechanisms 105 and 106 can comprise any type of clip, fastening device, etc., that can effectively be used to prevent telescoping handle 110 from disengaging unless the release and relating mechanisms are themselves removed or otherwise disengaged from mounting block 107. Moreover, release and retaining mechanism 105 and 106 can comprise a plurality of devices that operate in unison to release and retain telescoping handle 110, such as in the embodiment of FIG. 1, where the retaining clips and sets of screws are required to perform both the release and retaining functions. Further, in certain embodiments only a single release and retaining mechanism can be used, i.e., instead of two release and retaining mechanisms 105 and 106.

FIG. 2 is a diagram illustrating an exemplary embodiment of mounting base 107 in accordance with on embodiment of the system and methods described herein. Also illustrated in FIG. 2 are the lower portions of telescoping poles 103 and 104. As can be seen in FIG. 1, telescoping poles 103 and 104 can comprise retaining sleeves 120 and 121. When installed in mounting base 107, retaining sleeves 120 and 121 can reside under collars 108–111. Retaining sleeves 120 and 121 can be configured to slide over the ends of telescoping poles 103 and 104, and with exterior dimensions to fit snuggly within the corresponding collars 108–111. Retaining sleeves 120 and 121 can be further provided with annular grooves so that, when fully inserted, the grooves align with gaps between collars 108 and 109 and 110 and 111 respectively, thus enabling retention by retaining clips 105 and 106. End caps 122 and 124 prevent retaining sleeves 120 and 121 from sliding past the ends of poles 103 and 104 and, hence, block removal of the retractable handle when secured with retaining clips 105 and 106. Upon removal of retaining clips 105 and 106, however, telescoping handle 110 can be removed from mounting base 107.

Retaining clips 105 and 106 can be secured using screws, as described, installed on either side of retaining clips 105 and 106 at location 126 and 128. Of course, in other embodiments, a single screw can be used to install each of retaining clips 105 and 106. Alternative fastening mechanisms can also be used, such as clips, bolts, etc.

In certain embodiments, the screws, or other fastening mechanism used, as well as clips 105 and 106, depending on the embodiment, can be made to stand out so that they are easy to locate. This can be important since replaceable telescoping handle 110 is suited for replacement by the user. An ordinary user may not, however, easily recognize what screws need to be removed in order to replace telescoping handle 110. Thus, making the screws, or other fastening mechanisms stand out can increase the ease with which telescoping handle 110 can be replaced by making them easy to locate. In one embodiment, for example, the screw heads are painted red so that they can be easily spotted. But any color paint, can be used as long as it causes the fastening mechanism to stand out.

The collars 108–111 and 120–121 and retaining clips 105 and 106 can be constructed of a suitable plastic or polymer material such as, for example Nylon or Delrin, that combine the desirable qualities of high strength and toughness together with low friction and low galling propensity.

Figure 3:
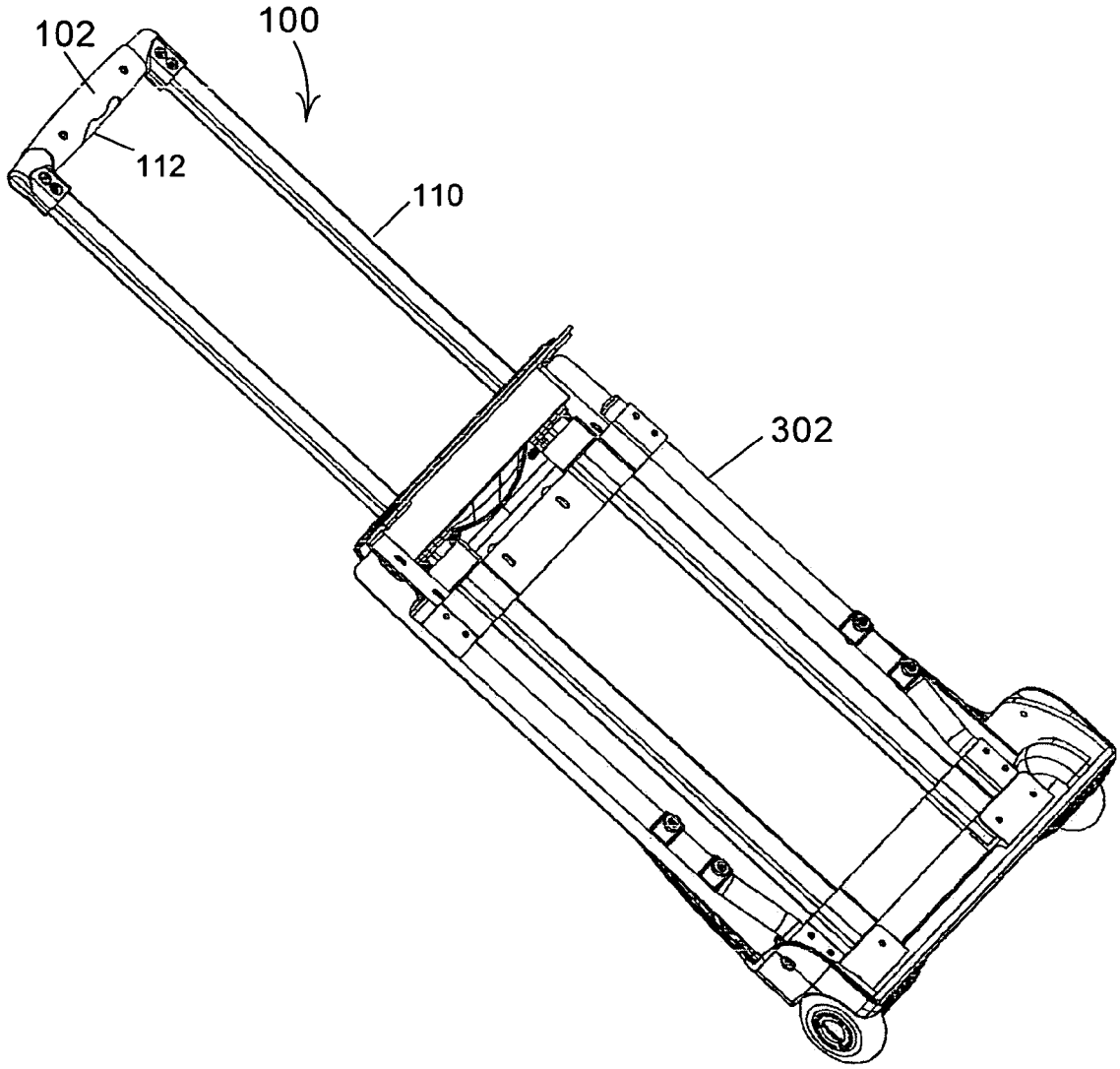
FIG. 3 is a diagram illustrating an exemplary frame or hand truck incorporating a replacement telescoping handle assembly in accordance with one embodiment and FIG. 4 is a flow chart illustrating an example method for replacing a broken telescoping handle in accordance with one embodiment.

FIG. 3 is a diagram illustrating an exemplary transport device 302, such as a frame or hand truck, incorporating a replacement telescoping handle assembly 100 in accordance with one embodiment of the systems and methods described herein. The assembled device 302 can be operated as shown for transporting heavy objects, or can additionally incorporate a soft or hard sided suitcase, thereby transforming it into a wheeled luggage embodiment. The particular embodiment shown in FIG. 3 can be robustly designed, for example, making it suitable for transporting loads greatly exceeding a weight that could be comfortably lifted by the typical user. The stress bearing components can be made of strong and light weight materials such as aluminum alloys or composites, particularly telescoping poles 103 and 104, where momentarily high stresses occasionally occur during use. For example, in one implementation, metal alloy tubing can be used for the telescoping pole construction, as is well known, to maximize bending and torsional strength while minimizing weight.

Figure 4:
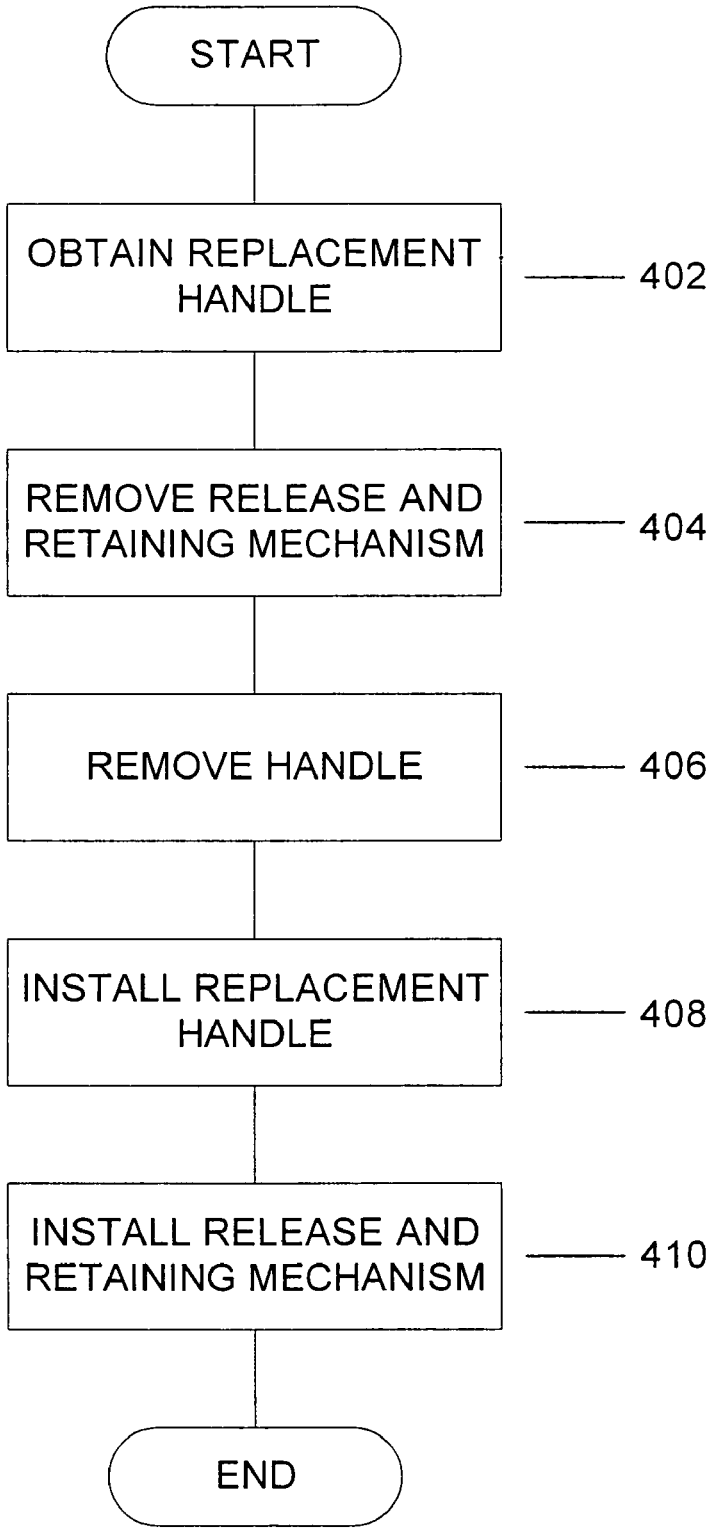

FIG. 4 is a flow chart illustrating an example method for replacing a broken telescoping handle with a replaceable telescoping handle 110 in accordance with one embodiment of the systems and methods described herein. Once a telescoping handle breaks, the user must first obtain a replaceable telescoping handle in step 402. For example, the user can obtain a new telescoping handle from the manufacturer or from a third party supplier. Then, in step 404, the user can remove, or otherwise disengage the associated release and retaining mechanism, or mechanisms. For example, the user can locate retaining clips 105 and 106 and the associated screws. As mentioned above, this can be made easier for the user of the screws, or clips are made to stand out, e.g., with red paint or markings.

In step 406, the broken telescoping handle can be removed, once the release and retaining mechanism(s) are disengaged. In step 408, the replacement telescoping handle obtained in step 402 can then be installed and the release and retaining mechanism(s) can be reinstalled in step 410. At this point, the associated transport device should be ready for use.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed is:

1. A mounting block configured to receive a telescoping handle for a transport device, comprising:

a base;

a first collar and a second collar separated by a gap secured to the base, where the first collar and the second collar each has an opening that is aligned for receiving the telescoping handle; and a release and retaining mechanism configured to fit within the gap to secure the telescoping handle to the base while enabling the telescoping handle to adjust its position relative to the base without separating the telescoping handle from the base when the release and retaining mechanism is installed and to separate the telescoping handle from the base when the release and retaining mechanism is removed.

2. The mounting block of claim 1, wherein the release and retaining mechanism comprises a retaining clip.

3. The mounting block of claim 2, wherein the retaining clip is installed or removed using one or more screws.

4. The mounting block of claim 3, wherein at least one of the retaining clip and the screw is configured to stand out relative to the base.

5. The mounting block of claim 4, wherein at least one of the retaining clip and the screw is painted in a color that is contrast to a color of the base.

6. The mounting block of claim 1 wherein the first collar and the second collar are constructed as a unitary structure.

7. The mounting block of claim 1 wherein the first collar, the second collar, and the base are constructed as a unitary structure.

8. A telescoping handle assembly for a transport device, comprising:

a telescoping handle comprising an inner segment and an outer segment, the inner segment adapted to slide within the outer segment; and a mounting block configured to receive the telescoping handle, the mounting block comprising a base, a first collar and a second collar separated by a gap and secured to the base, and a release and retaining mechanism, wherein the first collar and the second collar each has an aligned opening for receiving the inner segment and the release and retaining mechanism is configured to fit within the gap to secure the inner segment to the base while enabling the inner segment to adjust its position relative to the base without separating the inner segment from the base when the release and retaining mechanism is installed and to separate the inner segment from the base when the release and retaining mechanism is removed.

9. The telescoping handle assembly of claim 8, wherein the release and retaining mechanism comprises a retaining clip.

10. The telescoping handle assembly of claim 9, wherein the retaining clip is installed or removed using one or more screws.

11. The telescoping handle assembly of claim 10, wherein at least one of the retaining clip and the screw is configured to stand out relative to the base.

12. The telescoping handle assembly of claim 11, wherein at least one of the retaining clip and the screw is painted in a color that is contrast to a color of the base.

13. The telescoping handle assembly of claim 8, wherein the inner segment comprises a retaining sleeve surrounding the inner segment and having a groove, and the first collar, the second collar and the gap are sized and shaped to receive the retaining sleeve such that the groove and the gap are aligned when the retaining sleeve is received within the first collar and the second collar.

14. The telescoping handle assembly of claim 13, wherein the inner segment comprises an end cap provided at one end of the inner segment which slides within the outer segment and sized and shaped to prevent the retaining sleeve from sliding beyond the end cap when the release and retaining mechanism is installed.

15. The telescoping handle assembly of claim 8 wherein the first collar and the second collar are constructed as a unitary structure.

16. The telescoping handle assembly of claim 8 wherein the first collar, the second collar, and the base are constructed as a unitary structure.

17. A method for replacing a telescoping handle for a transport device that is secured to a mounting block, comprising:

providing the telescope handle comprising an inner segment and an outer segment wherein the inner segment slides within the outer segment;

providing a mounting block which comprises a base and a first collar and a second collar separated by a gap and secured to the base, where the first collar and the second collar each has an aligned opening, and wherein the inner segment is received within the aligned opening and secured to the base of the mounting block by a release and retaining mechanism which is provided within the gap, while enabling the inner segment to adjust its position relative to the base without separating the inner segment from the base;

disengaging the release and retaining mechanism;

separating the inner segment from the base;

installing a new inner segment; and engaging the release and retaining mechanism to secure the new inner segment to the base.

18. The method of claim 17, wherein the release and retaining mechanism comprises a retaining clip secured using one or more screws and disengaging the release and retaining mechanism comprising removing the one or more screws to separate the retaining clip from the base and engaging the release and retaining mechanism comprises tightening the one or more screws to secure the retaining clip to the base.

19. The method of claim 17, wherein installing a new inner segment comprises providing an inner segment comprising a sleeve surrounding the inner segment and having a groove and inserting the sleeve within the first collar and the second collar such that the groove and the gap are aligned.

20. The method of claim 17, further comprising locating the release and retaining mechanism using an identifying color associated with the release and retaining mechanism.

* * * * *